United States Patent [19]

Tetrault et al.

[11] Patent Number: 4,746,774

[45] Date of Patent: May 24, 1988

[54] MINIATURE ACCELERATION SWITCH

[75] Inventors: Leonard P. Tetrault, Northport; James R. Miller, Center Moriches, both of N.Y.

[73] Assignee: Aerodyne Controls Corporation, Ronkonkoma, N.Y.

[21] Appl. No.: 103,121

[22] Filed: Sep. 28, 1987

[51] Int. Cl.[4] ..... H01H 35/14

[52] U.S. Cl. ..... 200/61.45 R; 200/61.53

[58] Field of Search ..... 200/61.45 R, 61.48–61.49, 200/61.51, 61.52, 61.53

[56] References Cited

U.S. PATENT DOCUMENTS

| | | | |
|---|---|---|---|
| 2,424,390 | 7/1947 | Ferris | 200/61.53 |
| 3,035,521 | 5/1962 | Hynard | 200/61.45 R X |
| 3,649,787 | 3/1972 | Kasabian | 200/61.45 R |
| 3,731,022 | 5/1973 | Loftus | 200/61.53 X |
| 3,889,130 | 6/1975 | Breed | 200/61.53 X |
| 3,889,649 | 8/1975 | Jenkins | 200/61.45 R X |
| 3,965,314 | 6/1976 | Sasaya et al. | 200/61.53 |
| 4,210,789 | 7/1980 | Ushiku et al. | 200/61.53 |

*Primary Examiner*—J. R. Scott

*Attorney, Agent, or Firm*—Edward H. Loveman

[57] ABSTRACT

This miniature acceleration switch has a cylindrical metal mass movable axially in a cylindrical chamber in a cylindrical metal shell. The chamber is filled with an inert gas to inhibit corrosion. The mass has a frustoconical end section inserted into a metal coil spring engaged at one end on an annular shoulder at the wider end of the section, and engaged at its other end in an annular recess formed in a metal ring of a header closing and welded to the other end of the chamber to seal it hermetically. The header has a glass insulator bonded to the ring and carries at its center a circuit lead projecting into the chamber to be contacted by the mass when it moves against a spring load in response to a predetermined force of acceleration.

11 Claims, 2 Drawing Sheets

MINIATURE ACCELERATION SWITCH

BACKGROUND OF THE INVENTION

1. Field of the Invention.

This invention relates to the art of electrical acceleration switches, and more particularly concerns a miniature acceleration switch of the type having mass movable against spring bias in a housing to contact a switch terminal.

2. Description of the Prior Art.

A typical prior miniature acceleration switch of the type dealt with in this application is shown in FIG. 1. Parts are broken away to show internal parts. A switch 10 has a circuit lead 12 connected to a closed circular end wall 14 at one end of a cylindrical shell 16. A disk-like header 18, has an annular flange 20 welded to an annular flange 22 at the other end of the shell 16. The header 18 has an electrically conductive outer ring portion 24 and a central circular insulator 26. Another circuit lead 28 extends through the center of the insulator 26 and a tip 29 of the lead 28 projects slightly into a closed cylindrical chamber 30. A cylindrical mass 32 made of electrically conductive material is slidable axially in the chamber 30. The mass 32 has a cylindrical end section 34 whose diameter is less than that of a cylindrical end section 36. A cylindrical coil spring 38 is disposed axially in the chamber 30. One end 37 of the spring 38 bears on a flat inner annular side 39 of the header ring 24. The side 39 is coplanar with the adjacent annular side of the insulator 26. The other end of the spring 38 bears against an annular shoulder 40 at the junction of the sections 34 and 36 of the mass 32. The end section 34 of the mass 32 extends axially for its entire length into the coil spring 38. Flat circular end 41 of the mass 32 is normally spaced from the lead tip 29 by the load or bias in the spring 38. When the switch is accelerated in any direction, so that there is a component of sufficient force axial of the mass 32 directed toward the header 18, the mass 32 will move against the bias of the spring 38 to contact the lead tip 29 and connect leads 12 and 28 in a direct electric circuit including the shell 16, and the mass 32.

It has been found in practice that the type of acceleration switch shown in FIG. 1 is not 100% reliable in operation, for a number of reasons. For example:

1. There is often a tendency for the spring coil turns to slip or twist laterally in the space between a flat end 41 of the mass 32 and the header 18 or to slide laterally at the side 39 of the header 18 to stop movement of the mass 32 and to prevent closing of the switch by preventing contact of the mass 32 with the lead tip 29.

2. There is a tendency for turns of the spring 38 to slide radially and axially over one another laterally of the mass section 36 to twist on each other and thereby to jam the mass 32 in place and prevent its axial movement.

3. The operating point of the switch may vary unacceptably from a specified value due to the friction between the inside diameter of the mass 34 and the coils of the spring 38 as the mass moves toward the lead tip 29.

4. The switch has a limited shelf life because it is unsealed. If it is stored for long periods, the insulator 26, often made of plastic, deteriorates and the particles thereof, may break off inside the chamber 30 and obstruct the mass 32 from moving or may lodge between the header 18 and the adjacent end 41 of the mass 32 to prevent the switch from closing.

5. The air in the unsealed switch and any air which leaks into the switch contains moisture which in turn causes corrosion to develop on the inside walls of the shell 16 and the mass 32, so that the mass is frozen in place and will not move.

6. Corrosion developing on the spring 38 changes the response parameters of the switch, which is very undesirable.

7. There is a tendency for corrosion to develop on the the mass 32, on the inner side 39 of the ring 24, and on the tip 29 of the lead 28, so that the switch is permanently open circuited between the leads 12 and 28 or closed contact resistance between the leads 12 and 28 becomes unacceptable.

SUMMARY OF THE INVENTION

The present invention is directed at providing an improved miniature acceleration switch which avoids the difficulties and disadvantages encountered with the prior switch as described above, and which in addition provides more reliable performance, with a longer shelf life. According to the invention, the mass is formed with a frustoconical end section having a curved, beveled end to prevent binding against the adjacent coil spring. The insulator in the header is made of glass which is dimensionally and chemically stable. An annular recess is formed in the metal ring of the header to seat the coil spring. The interior wall of the housing, header ring, movable mass, and coil spring, are made of highly conductive metal plated with gold or other corrosion resistant material. The coil spring is made of a fine gauge plated wire. The chamber in the switch housing is filled with an inert gas such as helium or nitrogrn, or a mixture thereof, and is hermetically sealed. All these modifications taken together cooperate to insure more reliable performance and longer shelf life, i.e. the operating point and satisfactory operation of the switch can be assured within 5% of specification over a period of 15 years or longer.

These and other objects and many of the attendant advantages of this invention will be readily appreciated as the same becomes better understood by reference to the following detailed description when considered in connection with the accompanying drawings in which:

DESCRIPTION OF THE PREFERRED EMBODIMENT

Figure 1:
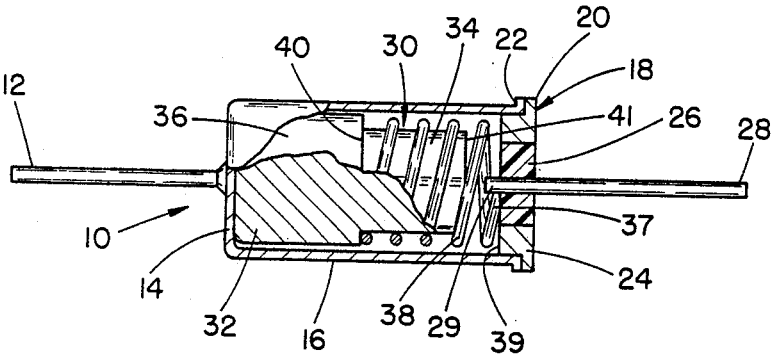
PRIOR ART FIG. 1
FIG. 1 is a side elevational view of a prior art form of switch, with some parts broken away to show internal construction, and with other parts taken in axial section.
Figure 2:
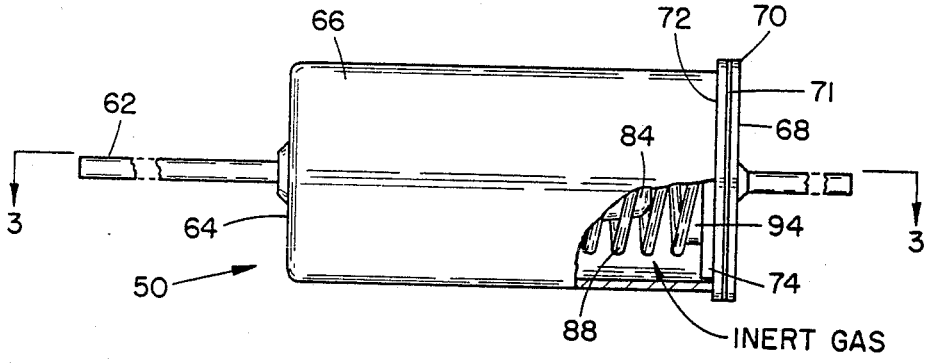
FIG. 2 is a side view of a greatly magnified miniature acceleration switch embodying the invention, parts being broken away.
Figure 3:
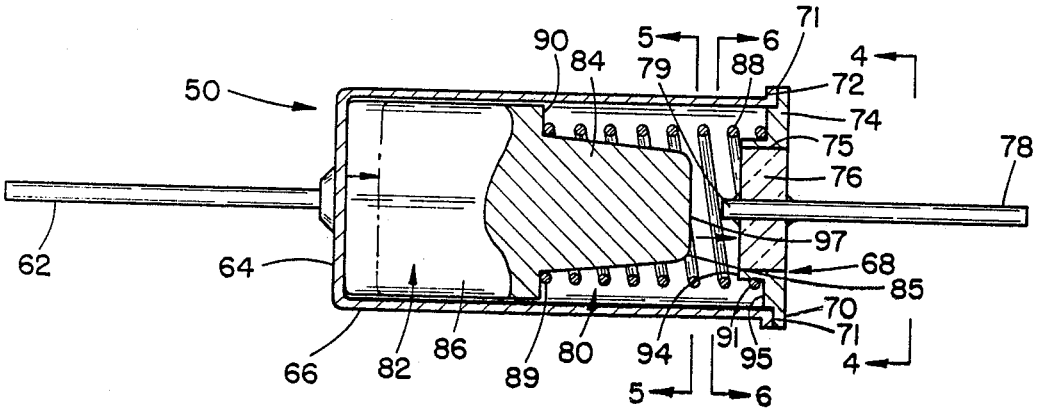
FIG. 3 is an axial sectional view taken along line 3—3 of FIG. 2.
Figure 6:
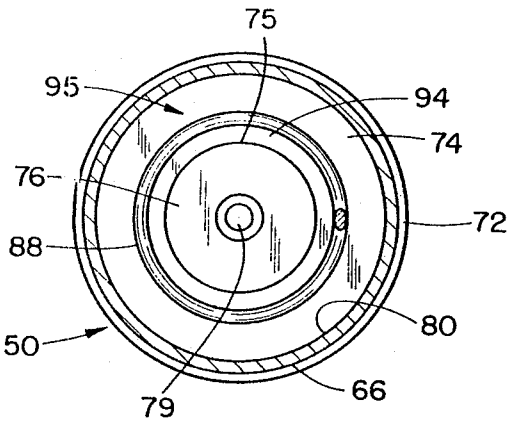
FIGS. 4, 5, and 6, are cross sectional views on an enlarged scale, taken along lines 4—4, 5—5, and 6—6 of FIG. 3.
Figure 5:
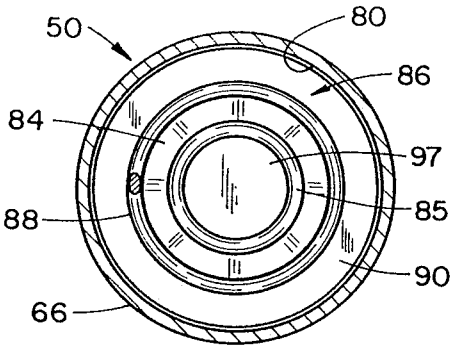
Figure 4:
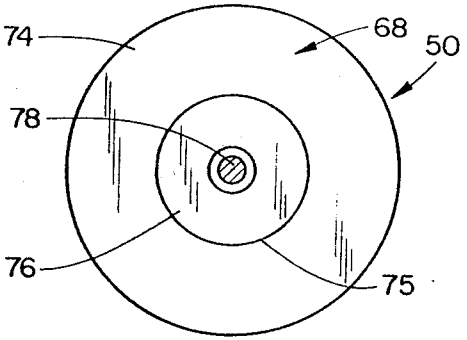
Figure 7:
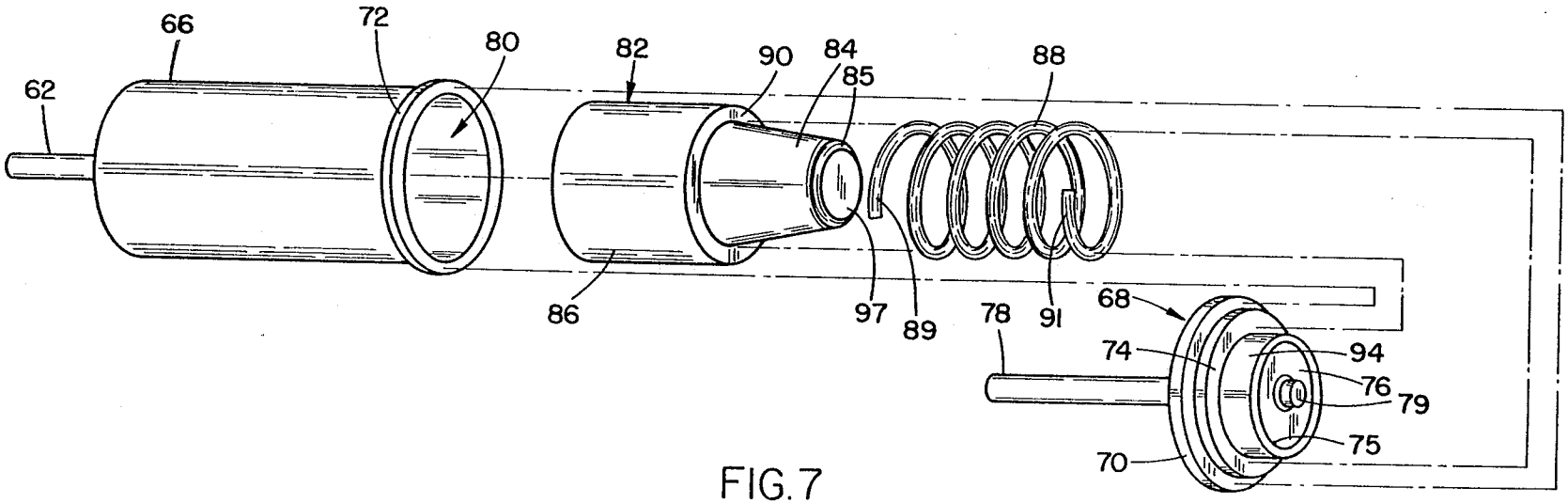
FIG. 7 is an exploded perspective view of parts of the acceleration switch of FIGS. 2-6, taken on a scale somewhat, smaller than those of FIGS. 2-6.

Referring now to the drawings wherein like reference characters designate like or corresponding parts throughout, there is illustrated in FIGS. 2-7, a miniature acceleration switch generally designated as reference numeral 50 embodying the invention. The new switch 50 has a circuit lead 62 connected to a closed circular end wall 64 of a cylindrical shell or housing 66. A disk-like header 68 has an annular peripheral flange 70 secured by a continuous weld 71 to an annular flange 72 at the other end of the shell 66. The header 68 has an electrically conductive outer ring or eyelet 74 and a circular glass insulator 76 set in a central opening 75 in the ring 74. Another circuit lead 78 extends through the center of the glass insulator 76 and a tip 79 of the lead 78 projects axially into a closed cylindrical chamber 80. A cylindrical mass 82, made of electrically conductive material, such as brass, is slidable axially in the chamber 80, and has a cylindrical outer portion 86 whose diameter is only slightly less than the diameter of the chamber 80, to insure easy sliding of the mass 82 axially of the chamber 80. The mass 82 has an annular shoulder 90 from which extends a frustoconical inner end section 84. The free end of the mass section 84 with a rounded chamfered or beveled edge or corner 85 fits axially for its entire length into a coil spring 88 disposed axially in the chamber 80. One end 89 of the spring 88 fits around the widest portion of the section 84 and bears against a flat, annular shoulder 90. The outer end 91 of the spring 88 fits around a collar or wall 94 of a recess 95 formed in the ring 74. A flat end 97 of the mass section 84 is normally spaced from the lead tip 79 by the bias in the spring 88. Due to its tapered form the frustoconical mass section 84 is spaced radially inward of all turns of the spring 88 except the first turn 89 at the shoulder 90. Only this first turn 89 may contact mass section 84 circumferentially.

By the arrangement described, the turns of the spring 88, are prevented from shifting laterally or overlapping and jamming the mass 82 and thereby preventing the mass from moving axially. When the switch 50 is accelerated in any direction so that there is a component of force of sufficient predetermined magnitude in a direction axial of the mass 82, the mass will move axially against the bias in the spring 88 (without rubbing against the turns of the spring 88) to compress the spring 88 and contact lead tip 79. This will close a direct electrical circuit between the leads 62 and 78 via the shell 66 and the mass 82. There will also be another direct electric circuit between the leads 62 and 78 via the shell 66, the ring 74, the spring 88, and the mass 82.

A miniature acceleration switch 50 as described may be used in very critical applications where reliable and proper operation is an absolute must. For example, in a military application the acceleration switch 50 may be used in a bomb carried by an airplane. The function of the switch is to prevent the bomb from detonating until it has acquired a predetermined velocity and has moved a safe distance away from the airplane, after the bomb has been dropped. Then the switch must close to arm the bomb. If the switch malfunctions, i.e. it fails to operate at all, the bomb will not be detonated. If the switch closes too fast, the bomb may explode prematurely and blow up the airplane from which it was dropped. If the switch closes too slowly, detonation of the bomb may occur too late or not at all. In another military application, a canister containing a number of bombs or submunitions is rotated along a longitudinal axis. After a particular r.p.m. of the canister is reached, the acceleration switch responds thereto and closes the contol circuit to detonate the canister thereby causing the contents thereof to scatter in a pattern depending on the r.p.m. Any failure to operate or improper operation of the switch is absolutely unacceptable, and will not occur with the present switch 50, although it may occur with switch 20.

The present invention has a number of further features which insure absolute reliability and long shelf life, so that it will operate properly according to specification fifteen years or more after manufacture and storage. As one important feature, the chamber 80 is filled with a dry inert gas, such as nitrogen or helium or a mixture thereof, at a low pressure so as not to interfere with operation of the switch, but it is sufficient to prevent corrosion of the internal parts of the switch assembly.

After the mass 82 and the spring 88 are installed, the chamber 80 is evacuated of air and filled with a dry inert gas. Then the header 68 is applied and the flanges 70, 72 are secured by continuous weld 71 to seal the chamber hermetically and permanently. The glass insulator 76 is stable dimensionally and is chemically inert so that it will not shrink away from the center of the ring 74 or the lead 78 to leak air as can happen with the prior switch 20 shown in FIG. 1. The spring ends 89, 91 cannot shift laterally to jam the mass. In switch 20, the spring end 37 can shift laterally on the flat side 39 of the header 18 to cause the entire spring to bend and jam the mass 32. This cannot occur with switch 50 because the end 91 of the spring is positively centered in recess 95. During axial movement of mass 82, the radial distance from the mass section 84 increases as the beveled flat end 97 approaches the lead tip 79. Any coil turns, which may shift laterally as the mass 82 advances and compresses the spring, cannot stop or jam the mass or prevent the mass from contacting the lead tip 79. In a typical miniature acceleration switch 50, the mass 82 will have a maximum diameter of 0.168 inches and the inside diameter of the shell 66 will be 0.170 inches to allow the mass 15 to slide freely axially. The shell 66 will be 0.415 inches long with a flange diameter of 0.210 inches. The normal spacing or gap between the flat end 97 of the mass 82 and the lead tip 79 is 0.025 inches. By the new features described above the useful life of the switch during which it will retain its specified operating parameters is extended to fifteen years or more. The miniature acceleration switch will operate at all times in response to a force of acceleration within 5% of that specified or prescribed. All parts of the switch may be made by precision, mass production methods to minimize cost of manufacture.

Although the outer end 91 of the spring 88 has been described and shown as fitting around a collar or wall 93 of a recess 95 formed in the ring 74 it is obvious that the recess 95 may be merely an annular groove in which the outer end 91 of the spring 88 will fit.

It should be understood that the foregoing relates to only a preferred embodiment of the invention, which has been by way of example only, and that it is intended to cover all changes and modifications of the examples of the invention herein chosen for the purpose of the disclosure, which do not constitute departures from the spirit and scope of the invention.

What is claimed is:

1. A miniature acceleration switch, comprising:

a hollow cylindrical electrically conductive metal shell closed at one end and open at its other end to define a cylindrical chamber therein;

an electrically conductive metal mass axially movable in said chamber, said mass having:

a cylindrical section having one end normally disposed adjacent said closed end of said shell in axial alignment therewith, and having a diameter slightly smaller than that of said chamber to slide freely in said shell; and a frustoconical section integral with the other end of said cylindrical section and in axial alignment therewith, said frustoconical section having a diameter at its widest end smaller than said diameter of said cylindrical section to define an annular shoulder at the other end of said cylindrical section;

a header closing said chamber at the other end of said shell, said header having:

an electrical conductive metal ring secured to said shell;

a central insulator bonded to and inside of said ring; and a first circuit lead extended axially through said insulator and bonded thereto, said lead having a tip end projecting slightly into said chamber axially thereof, said frustoconical section having a narrow other end normally spaced from said tip end of said lead; and a cylindrical, electrically conductive, metal coil spring in said chamber extending axially thereof and axially receiving the entire length of said frustoconical section of said mass, one end of said spring bearing on said annular shoulder and the other end of said spring bearing on said ring of said header; whereby said mass moves axially in said chamber against increasing axial load in said spring to compress the spring when a force of acceleration of sufficient magnitude is applied to said mass, until said mass contacts said tip of said lead in direct electrical circuit therewith.

2. A miniature acceleration switch as defined in claim 1, wherein said ring in said header is formed with a collar in said closed chamber for receiving the other end of said spring, said ring and said frustoconical section at its widest end engaging opposite end of said spring and preventing lateral movement thereof at all times to avoid twisting of turns of said spring and to prevent jamming of said mass against axial movement.

3. A miniature acceleration switch as defined in claim 1, wherein said chamber is filled with inert gas to prevent corrosion of metal parts in said chamber.

4. A miniature acceleration switch as defined in claim 1, wherein said frustoconical section of said mass is so tapered that all sides of said frustoconical section are radially spaced from all turns of said spring except the one turn at said one end of said spring bearing on said annular shoulder, so that said mass cannot be jammed by said spring against axial movement of said mass if any intermediate turn of said spring shifts laterally.

5. A miniature acceleration switch as defined in claim 1, wherein said ring in said header is formed with an annular groove for receiving the other end of said spring, said ring and said frustoconical section at its widest end engaging opposite ends of said spring and preventing lateral movement thereof at all times to avoid twisting of turns of said spring and to prevent jamming of said mass against axial movement.

6. A miniature acceleration switch as defined in claim 1, wherein said insulator is made of dimensionally and chemically stable material such as glass, said insulator being fused to said ring in a permanent, hermetically sealed bond.

7. A miniature acceleration switch as defined in claim 1, wherein said ring has a first peripheral, annular flange and said shell has another peripheral annular flange abutted to said first flange in circumferential and radial registration; and a continuous weld at said flanges bonding said header to said shell in a permanent, hermetic seal.

8. A miniature acceleration switch as defined in claim 1, comprising a second circuit lead in electrical contact with said shell, so that both of said circuit leads are connected in a direct electric circuit via said shell and said mass when said mass contacts said tip end of said first circuit lead.

9. A miniature acceleration switch as defined in claim 4, wherein said narrow other end of said frustoconical section is rounded and is widely spaced radially from said spring so that said mass cannot be jammed by said spring against axial movement, if any intermediate turn of said spring shifts laterally and interposes itself between said free other end of said frustoconical section and said header.

10. A miniature acceleration switch as defined in claim 9, wherein said ring in said header is formed with an annular recess receiving the other end of said spring, said ring and said frustoconical section at its widest end engaging opposite end turns of said spring and preventing lateral movement of said end turns at all times to prevent twisting of said spring and thus, to prevent jamming of said mass against axial movement.

11. A miniature acceleration switch as defined in claim 10, comprising a second circuit lead secured to said shell, so that both of said circuit leads are connected to one direct electric circuit via said shell and said mass, and in another direct electric circuit via said shell, ring, spring, and mass, when said mass contacts said tip end of said first circuit lead.

* * * * *